US007454924B2

(12) United States Patent
Grad

(10) Patent No.: US 7,454,924 B2
(45) Date of Patent: Nov. 25, 2008

(54) CONFIGURABLE JEWELRY AND JEWELRY CONFIGURATION SYSTEM

(76) Inventor: Frank Grad, 120 N. Damen Ave., Chicago, IL (US) 60622

( * ) Notice: Subject to any disclaimer, the term of this patent is extended or adjusted under 35 U.S.C. 154(b) by 232 days.

(21) Appl. No.: 11/213,090

(22) Filed: Aug. 26, 2005

(65) Prior Publication Data

US 2007/0044509 A1 Mar. 1, 2007

(51) Int. Cl.
*A44C 17/02* (2006.01)

(52) U.S. Cl. ..... 63/28; 63/26

(58) Field of Classification Search ..... 63/1.11, 63/1.16, 1.17, 1.18, 18, 33, 40, 41, 26–31; D11/87, 91, 92
See application file for complete search history.

(56) References Cited

U.S. PATENT DOCUMENTS

| | | | | |
|---|---|---|---|---|
| 859,162 | A * | 7/1907 | Worth | 63/30 |
| 1,186,271 | A * | 6/1916 | Block | 63/15.2 |
| 5,285,659 | A * | 2/1994 | Bardisbanyan | 63/26 |
| 5,765,398 | A * | 6/1998 | Bardisbanyan | 63/26 |
| 5,996,374 | A * | 12/1999 | Bardisbanyan | 63/15 |
| 6,053,009 | A * | 4/2000 | Broggian | 63/38 |
| 6,116,054 | A * | 9/2000 | Czupor | 63/26 |
| 6,584,804 | B1 * | 7/2003 | Freedman et al. | 63/26 |
| 6,612,132 | B2 * | 9/2003 | Kimura et al. | 63/31 |
| 6,820,442 | B2 * | 11/2004 | Kimura | 63/31 |
| 7,017,369 | B2 * | 3/2006 | Roberts-Shea | 63/15 |

FOREIGN PATENT DOCUMENTS

| | | | |
|---|---|---|---|
| CH | 683489 A5 | * | 3/1994 |
| CH | 3510200 | * | 3/1994 |
| FR | 2 681 653 | * | 3/1993 |

* cited by examiner

*Primary Examiner*—Robert J Sandy
*Assistant Examiner*—Ruth C Rodriguez
(74) *Attorney, Agent, or Firm*—Brinks Hofer Gilson & Lione

(57) ABSTRACT

A jewelry article is assembled with prefabricated precision components suitable for mass production. The components include bounding elements, fasteners, and spacers. The bounding elements include fastener apertures and channels for receiving portions of adornments. The fasteners secure the adornments in the channels between the bounding elements. From the available selection of bounding elements, fasteners, spaces, and other configuration options, an enormous variety of custom jewelry may be assembled. Accordingly, the consumer may obtain a unique piece of jewelry without the cost, expense, and time normally associated with custom jewelry creation.

19 Claims, 17 Drawing Sheets

CONFIGURABLE JEWELRY AND JEWELRY CONFIGURATION SYSTEM

BACKGROUND

1. Technical Field

This invention relates to jewelry and jewelry configuration. More particularly, the invention relates to providing a wide array of jewelry articles with widely varying appearances assembled from a consistent selection of individual components.

2. Related Art

Jewelry and its manufacturing have changed little over the years. To manufacture a ring, for example, molten metal is generally poured into a mold to form the ring. While the mold provides a convenient mechanism for defining the shape and size of the ring, the molding process is not flexible: the mold produces the same ring every time.

Rings are often manufactured with mounting prongs or receptacles which accept adornments such as precious or semi-precious stones, gems, birthstones or other adornments. A craftsman forms an arrangement of the adornments an integral part of the ring. However, when a customer desires an alternate arrangement or selection of adornments or an alternate ring shape or design, the customer must rely again on the expertise of the craftsman. Regardless of the craftsman's skill level, modifying a ring to meet the customer expectations often cannot be accomplished at all, and when the modification can be accomplished, the craftsman may takes weeks to recast or redesign the ring.

Jewelry is manufactured using a vast selection of different metals, stones, shapes, sizes, and designs. Furthermore, every individual will have their own tastes and preferences for any of the metals, stones, shapes, or other design parameters. As a result, customer interest in alternate designs is a growing and significant challenge for the jewelry industry.

There is a need for addressing the problems noted above and others previously experienced in the creation and modification of jewelry.

SUMMARY

The present invention is defined by the claims which follow. This description summarizes some aspects of the configurable jewelry, but is not intended to describe every aspect. Accordingly, this summary does not limit the claims.

An article of jewelry is modularly assembled with prefabricated bounding elements (e.g., inner and outer rings) and fasteners. The bounding elements include channels which receive portions of adornments (e.g., an edge of a stone), and fastener apertures. The fasteners secure bounding elements together and at the same time secure the adornments in the channels. The channels may include a securing material such as an epoxy or low temperature solder to further secure the adornments in place.

In designing the jewelry article, a customer may select the adornments and bounding elements which interest them. The bounding elements include channels which receive portions of the adornments as well as fastener apertures. In addition, the customer may choose from a wide selection of fasteners, fastener caps, and other features. The fasteners are positioned between or through the fastener apertures of the bounding elements to secure the selected adornments in the channels between the bounding elements. All of the fasteners, caps, bounding elements, and/or other jewelry components may be interchangeable parts, thereby allowing extensive configuration and customization options for any given piece of jewelry.

In addition, a jewelry configuration system is disclosed. The jewelry configuration system comprises a processor and a memory coupled to the processor. The memory stores adornment records representing customer selectable decorative pieces, bounding element records, fastener records for fasteners that secure the adornments between the first and second bounding elements, and a configuration program. The configuration program is operable to display adornment selections based on the adornment records, bounding element selections based on the bounding element records, and fastener selections based on fastener records. An operator provides an adornment selection, a bounding element selections, and fastener selections. The configuration program then verifies manufacturing compatibility between the selections and initiates communication of a manufacturing order to a supplier.

DETAILED DESCRIPTION

The elements illustrated in the Figures interoperate as explained in more detail below. Before setting forth the detailed explanation, however, it is noted that all of the discussion below, regardless of the particular implementation being described, is exemplary in nature, rather than limiting. For example, although selected aspects, features, or components of the implementations are depicted as pins, threaded fasteners, and embellishments, other types of fasteners, connecting members, embellishments or ornaments may be employed. Furthermore, although the jewelry article described below is a ring intended to be worn on a finger, the discussion below applies to other articles of jewelry, such as bracelets, earrings, and necklaces.

It is also noted that, although this specification describes specific components of a jewelry configuration system, methods, systems, and articles of manufacture consistent with this technology may include additional or different components, implemented with a wide range of circuitry. For example, a processor may be implemented as a microprocessor, microcontroller, digital signal processor (DSP), application specific integrated circuit (ASIC), discrete logic, or a combination of other types of circuits or logic acting as explained below. Programs may be a function, subroutine, or in-line code present in another program, may be a separate program, may be distributed across several memories and processors, or may be partially or wholly implemented without software as a hardware realization of the processing discussed below.

Figure 1:
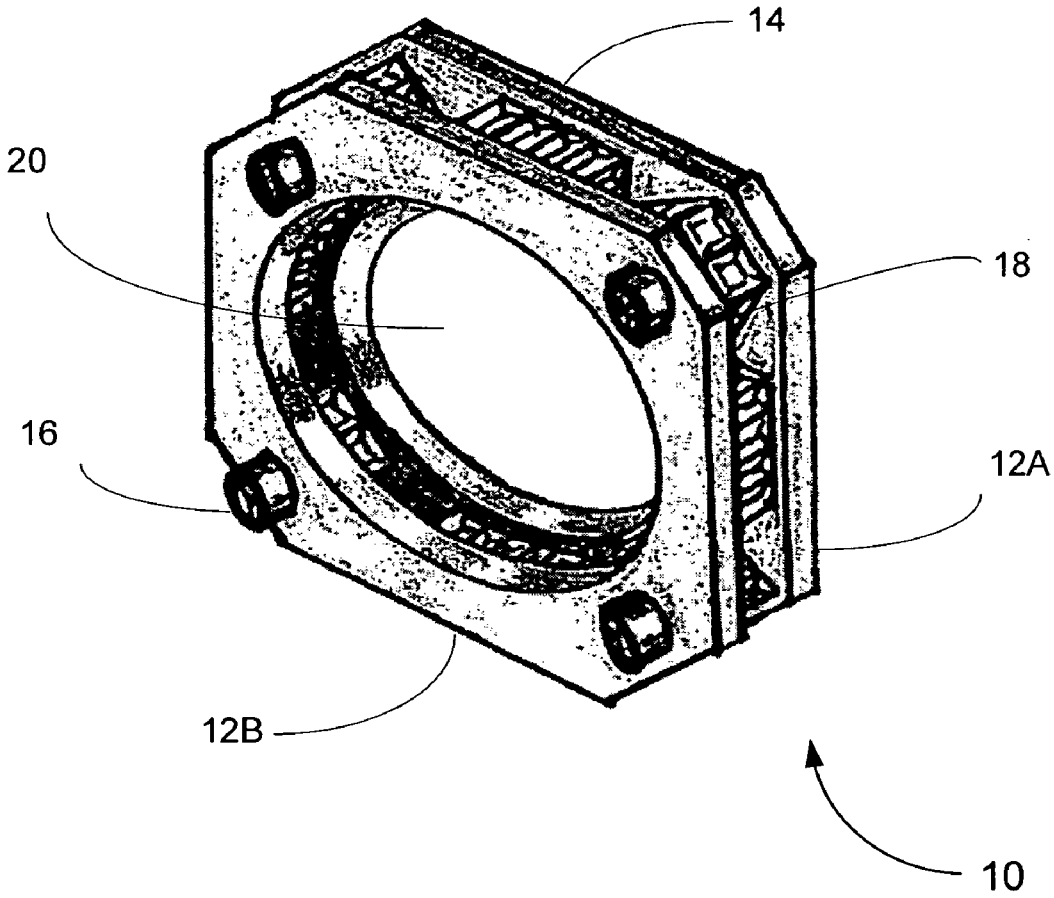
FIG. 1 is a perspective view of a configurable jewelry article.

FIG. 1 shows a jewelry article 10. The jewelry article 10 includes first and second bounding elements 12A and 12B, collectively: "bounding elements 12". The jewelry article 10 also includes adornments 14, and fasteners 16. The fasteners 16 secure the adornments between bounding elements 12. The adornments may be any embellishment for the jewelry article 10. Examples of adornments 14 include stones such as gemstones, pieces of precious metal, or any other enhancement for the jewelry article 10. The adornments 14 may be molded, cast, hand-tooled, or otherwise fabricated shapes of any material inserted between bounding elements 12. FIGS. 10*a-d* show additional examples of adornments 14.

The jewelry article 10 also includes spacers or spindles 18 which axially engage the fasteners 16 while positioned between the bounding elements 12. The bounding elements 12 are characterized by an inner diameter 20 which may be manufactured in different sizes to fit a finger (when the jewelry article 10 is a ring), a user's wrist (when the jewelry article 10 is a bracelet), or any other size appropriate for jewelry articles for other parts of the body.

Figure 2:
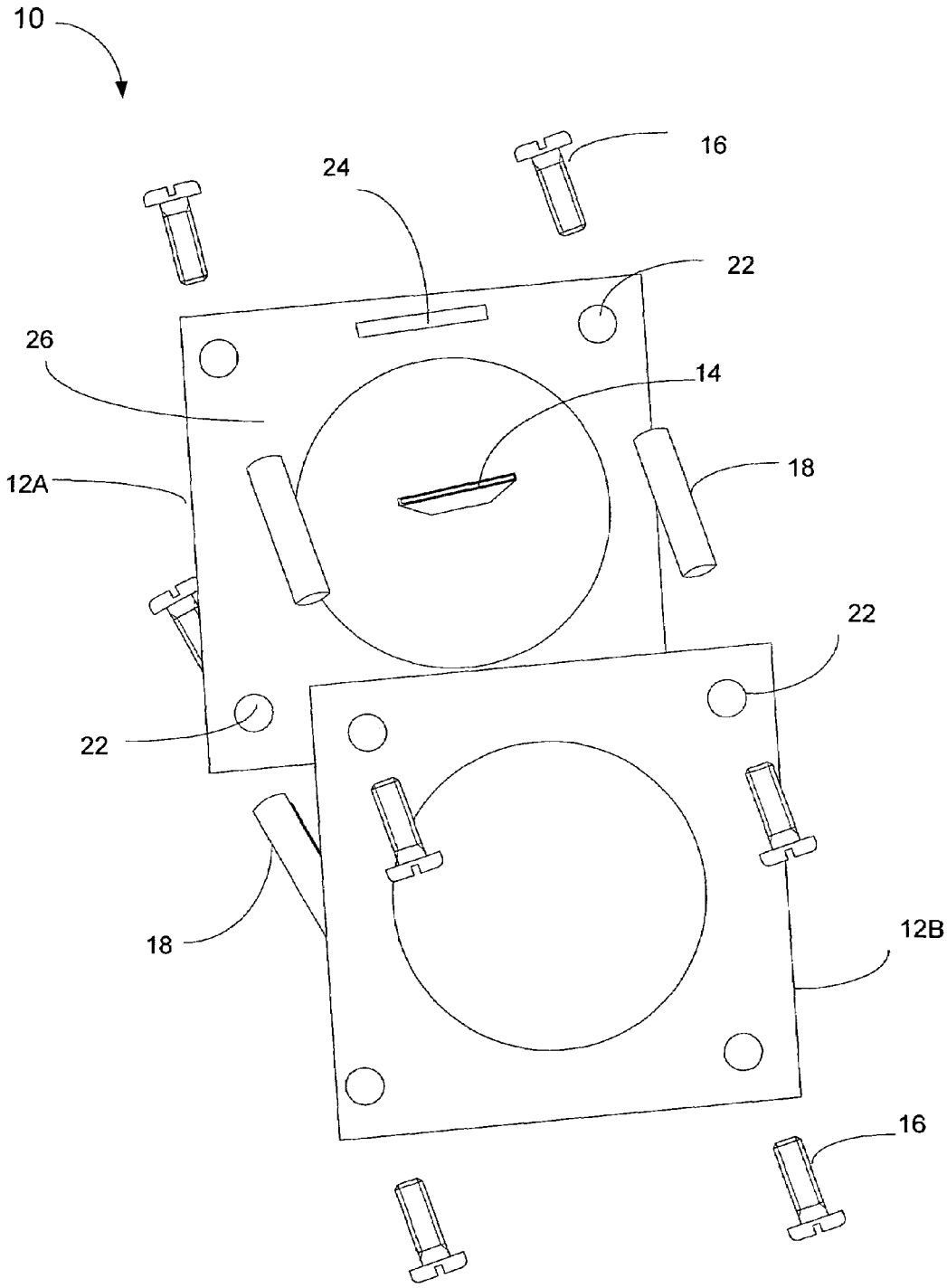
FIG. 2 is an exploded view of a configurable jewelry article.

FIG. 2 shows an exploded view illustration of a configurable jewelry article. The exploded view shows that the bounding elements 12 include apertures 22 and channels 24. The apertures 22 may each be formed as a hollow cavity which is sized and shaped to receive the fasteners 16. Accordingly, the fasteners 16 pass through the apertures 22 and engage the corresponding spacers 18. As will be explained in more detail below, the fasteners 16 and spacers 18 may be threaded, non-threaded, or partially threaded.

The channels 24 may be formed in the inner surfaces 26 of the bounding elements 12. The channels 24 may be sized and positioned to receive portions of the adornments 14. The channels 24 may be formed in proximity to the outer edges of the corresponding bounding elements 12 so that the adornments are readily visible. However, the channels 24 may be formed at any point on the inner surfaces 26 of the bounding elements 12. Accordingly, the jewelry allows the adornments to be positioned at a wide variety of positions within the jewelry itself, in contrast to traditional designs which limit the position of the adornments to the surface of the jewelry only.

Figure 3A:
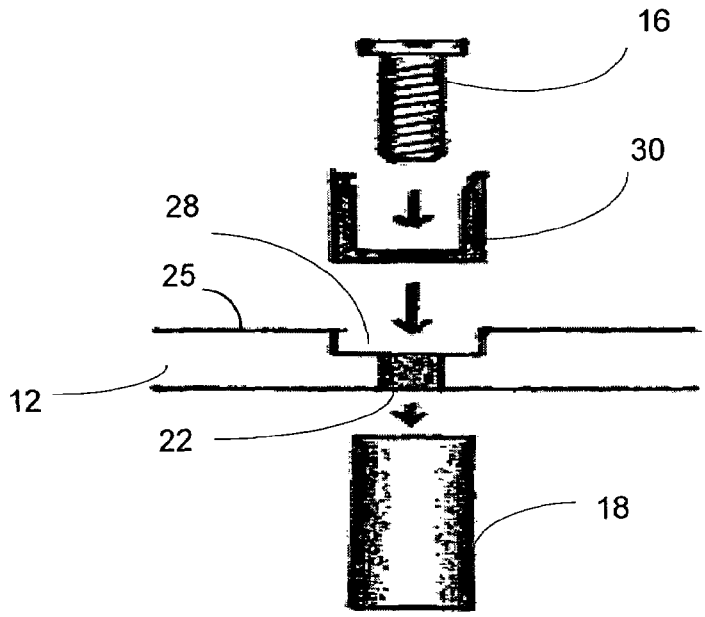
FIG. 3*a* is an exploded view of the fastening parts of a configurable jewelry article.

FIG. 3*a* shows an exploded view of a section of the jewelry article 10 which illustrates the engagement of the fastening parts of the jewelry article 10. The exploded view of the jewelry article 10 shows that the spacers 18 are aligned axially with the corresponding apertures 22 and the corresponding fasteners 16. The apertures 22 are shown as through-holes which include recesses 28 for fasteners having cylindrical heads.

Figure 3B:
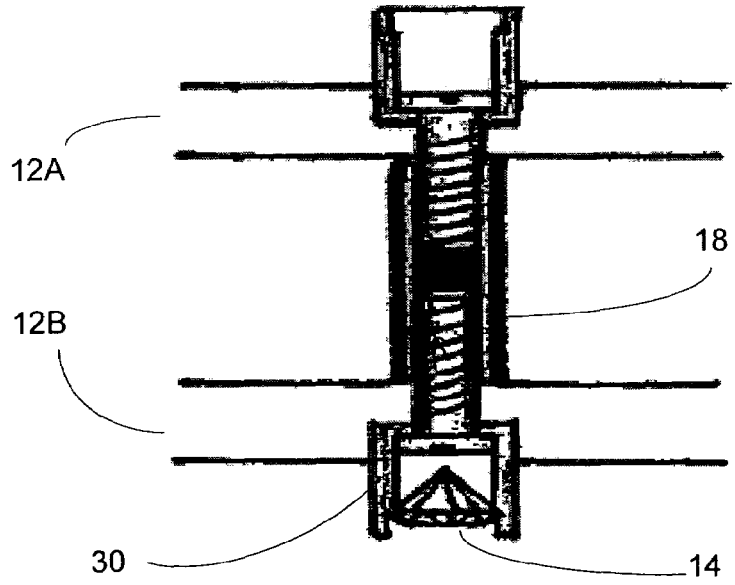
FIG. 3*b* is an assembled view of a configurable jewelry article.

In other designs, the countersinks 28 may accept bezels 30, as shown in FIG. 3*b*. The receptacles 30 may each be configured with an open end and a base opposite the open end, with the base having a through-hole to allow passage for the fasteners 16. As such, in the assembled state of jewelry article 10, the receptacles 30 are fixedly positioned in the countersinks 28 via the fasteners 16. Additional adornments 14 may be secured in the receptacles 30 to provide additional configuration options for the jewelry article 10.

Figure 4:
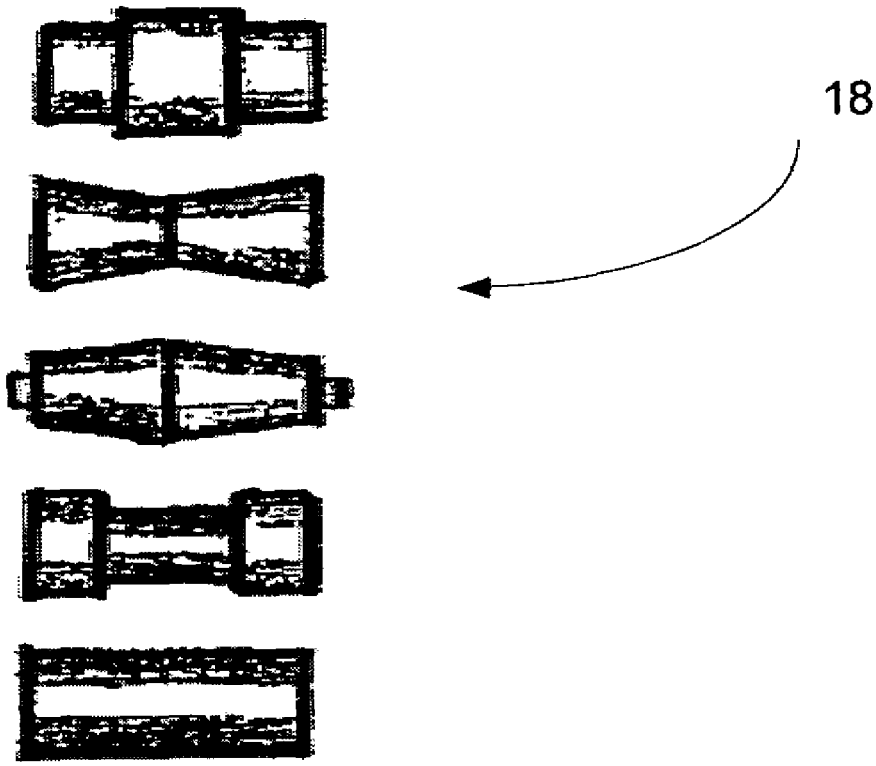
FIG. 4 are side views of spacers which may be employed in a configurable jewelry article.

FIG. 4 shows side views spacers 18 which may be used in the assembly of the jewelry article. The spacers 18 may vary widely in both shape and length. With regard to shape, the spacers 18 may be shaped in a variety of geometries or profiles, either symmetrically or asymmetrically. As examples, the spacers 18 may be round, triangular, square, or may have any other profile.

The spacers 18 may be chosen from a set of pre-fabricated selections, or may be manufactured to match a customer's desired shape or style. With regard to length, the spacers 18 may provide targeted or desired post-assembly distances between the inner surfaces 26 of bounding elements 12 so that the adornments 14 are fixedly positioned. The spacers 18 may include or may omit internal threads which engage fastener screws or rivets, for example.

Figure 5:
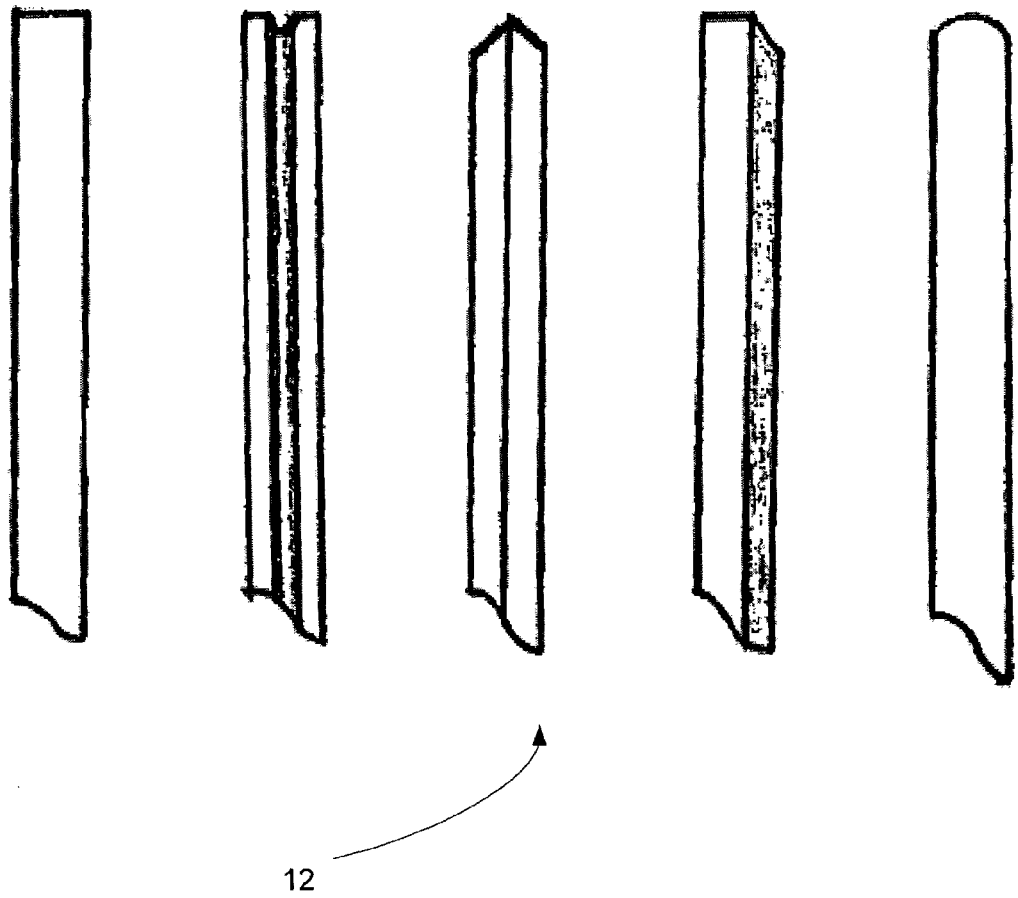
FIG. 5 shows views of side profiles of bounding elements which may be employed in a configurable jewelry article.

FIG. 5 shows alternate side profiles of the bounding elements 12 which may be employed in the assembly of the jewelry article 10. The bounding elements 12 may be shaped externally in a variety of geometries of profiles. Furthermore, the profiles may be straight or flat, concave, angular or knifed, beveled, or rounded. Any side profiles may be supplied by a set of pre-fabricated bounding elements 12, or may be manufactured to match the customer's desired geometry or style.

Figure 6A:
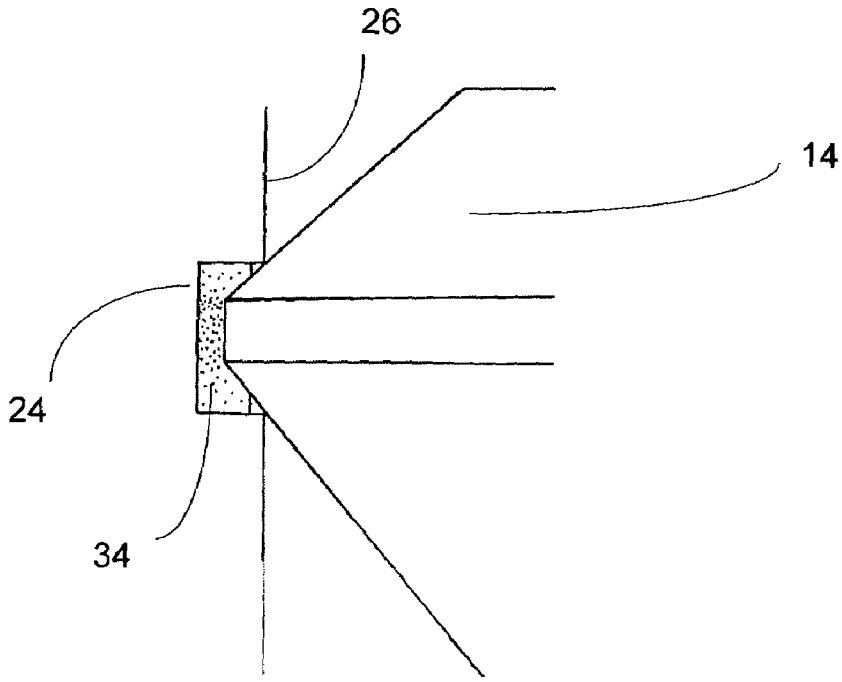
FIG. 6*a* is a cross-sectional illustration of an adornment and bounding element channels which may be employed in a configurable jewelry article.
Figure 6B:
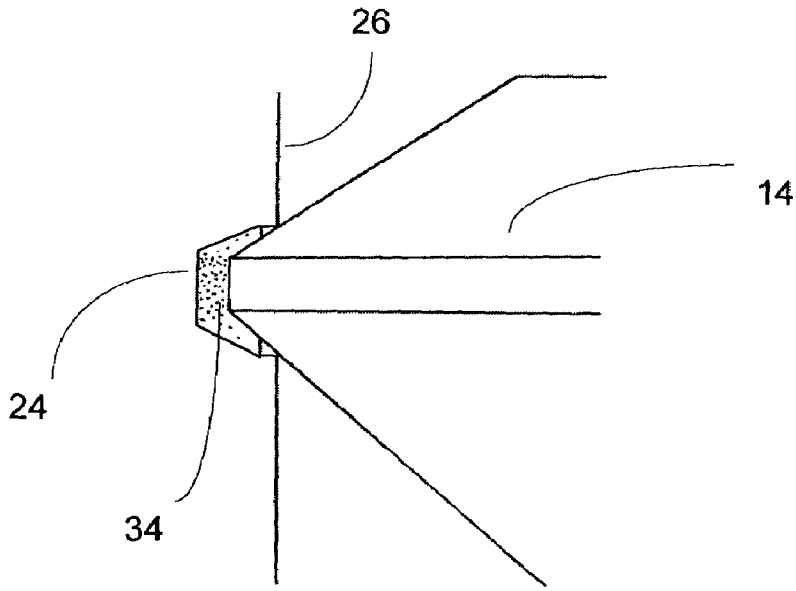
FIG. 6*b* is a cross-sectional illustration of an adornment and bounding element channels which may be employed in a configurable jewelry article.
Figure 6C:
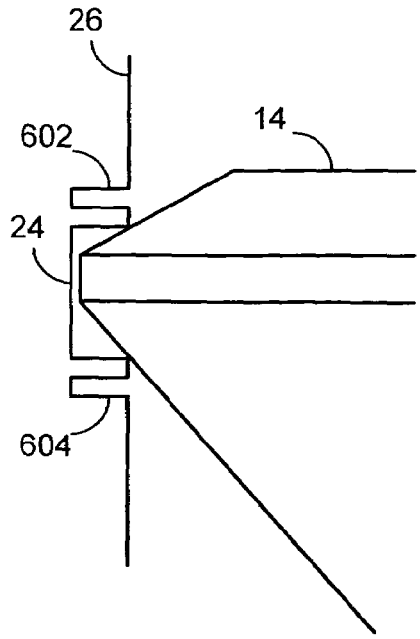
FIG. 6*c* is a cross-sectional illustration of an adornment and bounding element channels, and tension channels which may be employed in a configurable jewelry article.

FIGS. 6*a*-6*c* show cross-sectional illustrations of the engagement of an adornment 14 with alternate bounding element channels 24. The bounding element channels 24 may receive portions of adornments 14 (e.g., the edge of a gemstone). The channels 24 are further configurable with respect to both size and depth to provide a secure point of contact with the selected adornments 14 and spacers 18. A resin, epoxy, or other suspension material 34 (e.g., a silicone material) may be present in the channels 24.

FIG. 6*a* shows that the channel 24 has a rectangular cross-section, while FIG. 6*b* shows that the channel 24 may have a triangular cross section to meet an expected shape of the adornment 14. Other shapes, sizes, and geometries may be employed for the channels. Thus, the adornments 14 are aligned in the channels 24 during assembly of the jewelry article 10. The adornments may be readily removed and changed to create additional configuration options for the jewelry article 10 by removing the fasteners 16, pulling the bounding elements 12 apart, and changing the adornments 14.

Figure 6D:
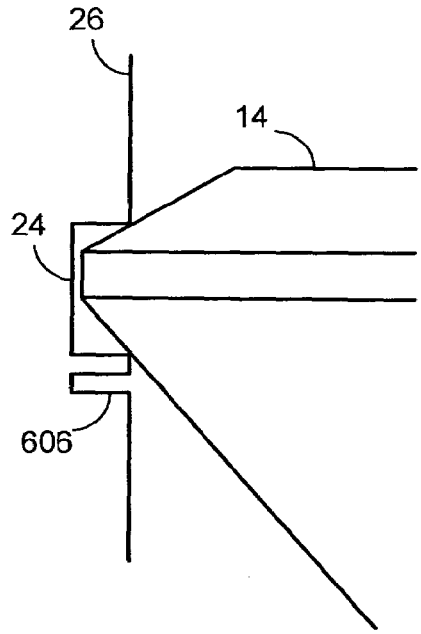
FIG. 6*d* is a cross-sectional illustration of an adornment and bounding element channels, and a tension channel which may be employed in a configurable jewelry article.

FIGS. 6*c* and 6*d* show an alternative implementation in which the inner surface 26 of the bounding element includes a primary channel 24 and tension channels. The tension channels may be provided above or below the primary channel 24. FIG. 6*c* shows two tension channels 602 and 604, while FIG. 6*d* shows an implementation with one tension channel 606 below the primary channel 24. The tension channels 602-606 may deform and/or deflect as the adornment 14 enters the primary channel 24 to provide a tension or friction fit against the adornment 14. The tension or friction fit further secures the adornment 14 in place when pressure is applied by the fasteners 16 during assembly.

Figure 7A:
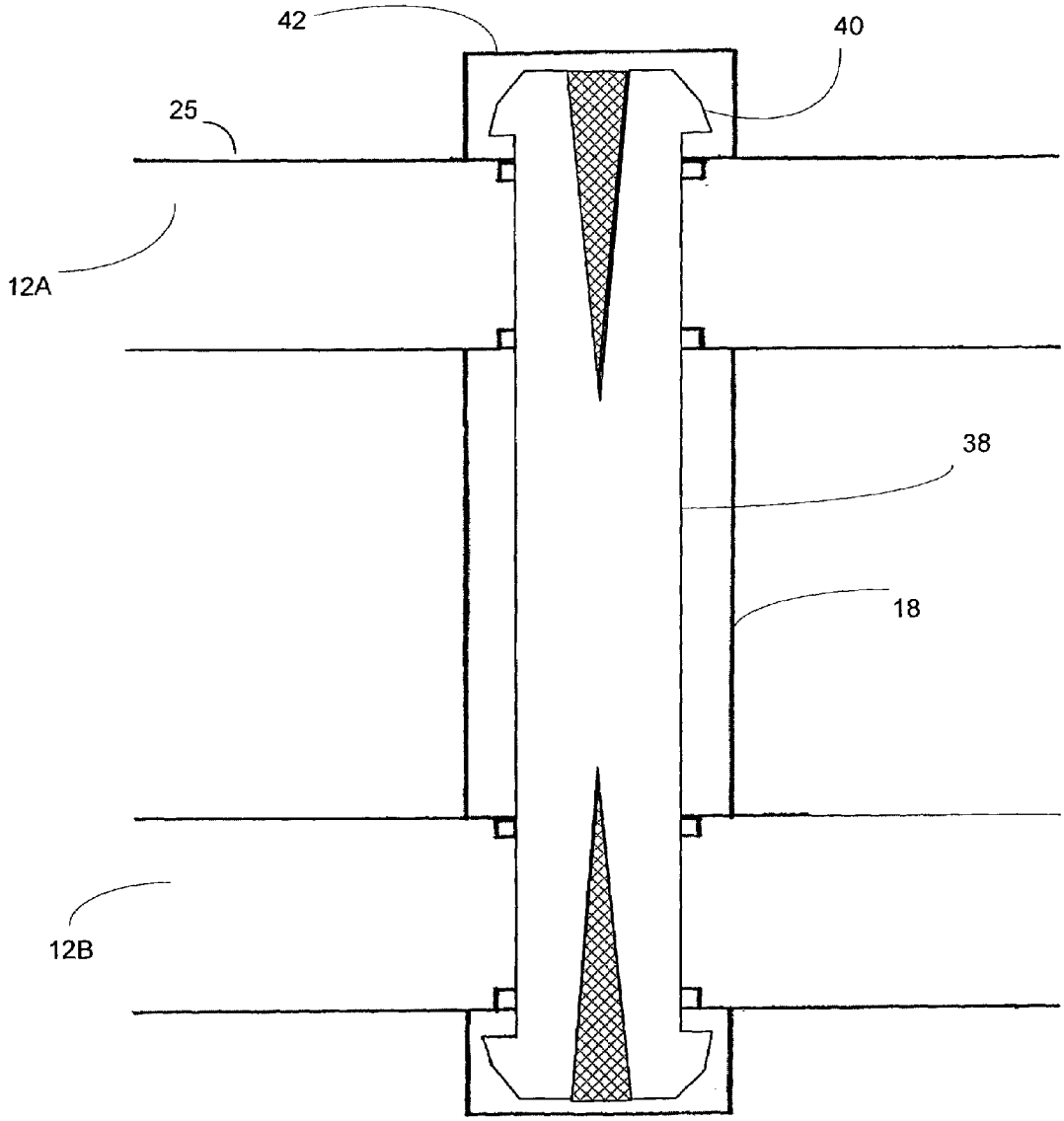
FIG. 7*a* is a cross-sectional illustration of an alternate fastener, a spacer and bounding elements which may be employed in a configurable jewelry article.
Figure 7B:
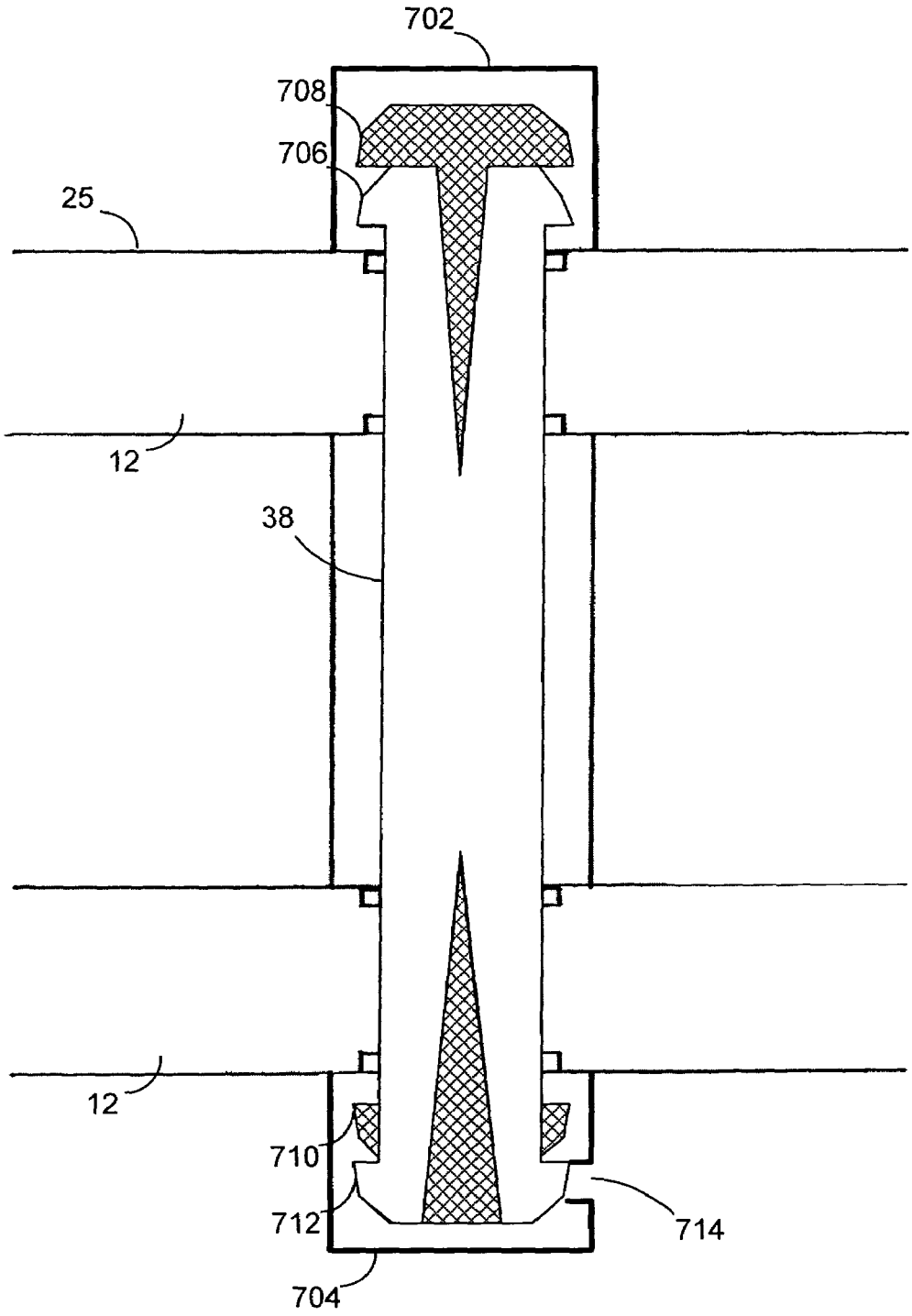
FIG. 7*b* is a cross-sectional illustration of a second example of an alternate fastener, a spacer and bounding elements which may be employed in a configurable jewelry article.
Figure 7C:
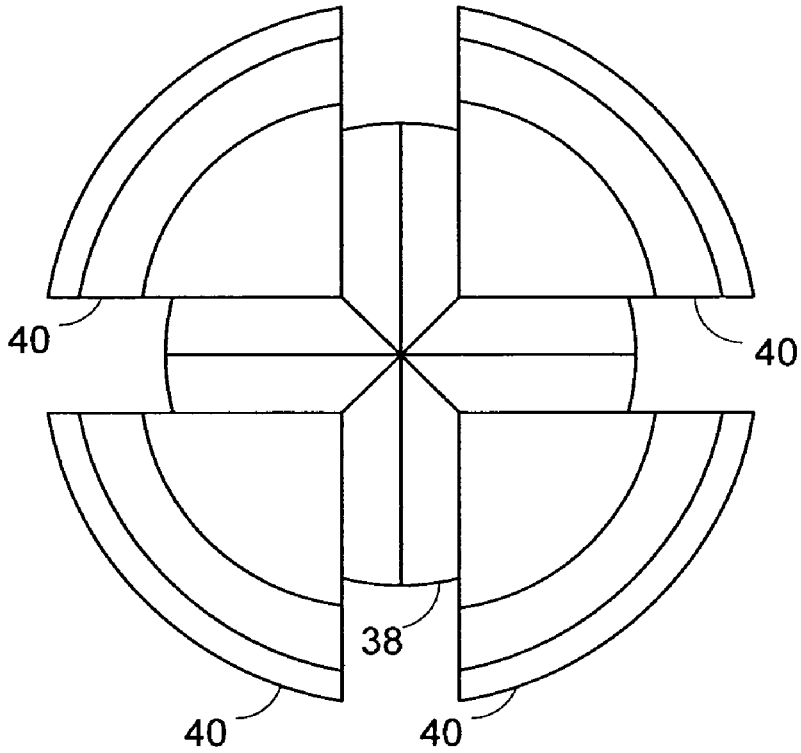
FIG. 7*c* shows a top view of the fastener shown in FIGS. 7*a* and 7*b*.
Figure 8:
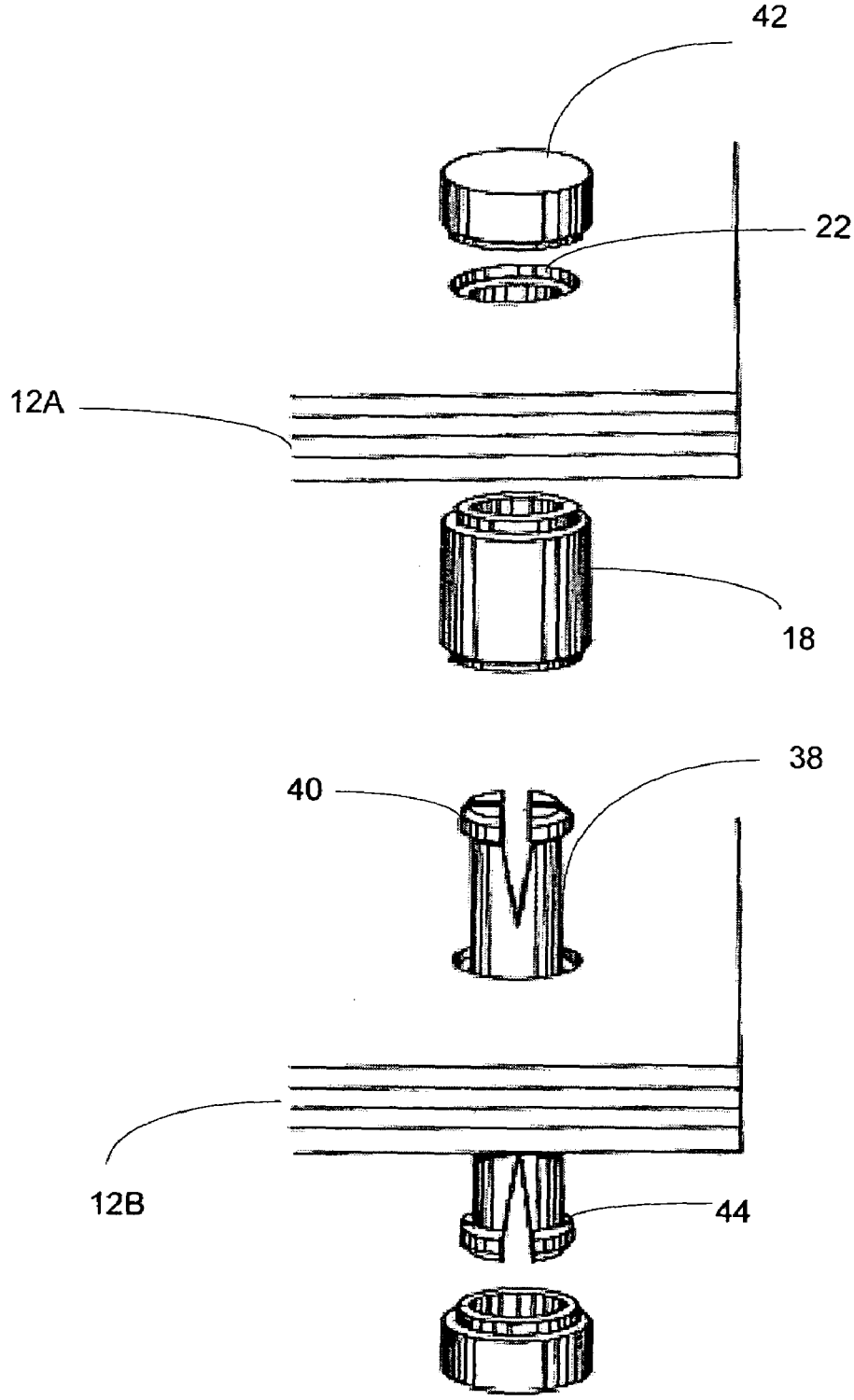
FIG. 8 is an exploded view of the jewelry article shown in FIG. 7.

FIGS. 7 and 8 show cross-sectional illustrations of alternate fasteners 38 with spacers 18 and bounding elements 12. In FIG. 7, the pins 38 include prongs 40 at both ends. The pins 38 may include two, three, four, or any other number of prongs 40. The prongs 40 are elastically deformable to squeeze through passageways, such as the apertures 22 and through the spacers 18. After the prongs move through the apertures 22, the prongs 40 release into a wider final position which secures the cap 42 to the fastener 38.

In addition, the prongs 40 may include flanges 44 which engage the bounding element outer surfaces 25 or their respective recesses 28. Each pin 38 may have a length which provides any specified post-assembly pressure when the pin 38 and bounding elements 12 are secured together. The cap 42 may cover the prongs 40, and may offer a substantially smooth surface or other appearance configuration options for the jewelry article 10. The caps 42 may be snap fit caps, threaded caps, or may be secured in other manners.

FIG. 7*b* shows an example in which the caps 702 and 704 provide multiple locking positions for the fastener 38. The caps 702 and 704 have material removed internally to define mating positions for the flanges 44. The cap 702 defines a first mating position 706 and a second, deeper, mating position 708. The cap 704 defines a first mating position 710 and a second, deeper, mating position 712. Any number of mating positions may be provided in any of the caps added to the jewelry article. The fastener tension may be increased by pressing the fastener 18 deeper into one or both of the caps 702 and 704.

The fastener 38 with prongs 40 may be used in other applications. For example, the fastener 38 may be used to secure together machine parts or other mechanical elements. To that end, the fastener 38 and prongs 40 may vary widely in size (e.g., from a few millimeters in length for jewelry applications to many tens or hundreds of millimeters or more for other applications) to accommodate the parts which it will secure. Suitable materials for the fastener 38 include steel, titanium, hardened aluminum, or other hard materials which provide a degree of spring to the prongs 40.

The caps 702 and 704 may also include release apertures. The release apertures may be implemented as slots or other openings through which a portion of a tool may pass to compress the prongs 40. When the prongs 40 are compressed, the cap may then be removed from the fastener 38. FIG. 7*b* shows a release aperture 714. The release apertures may be provided for one or more of the prongs 40 at one or more of the mating positions.

FIG. 7*c* shows a top view of the fastener 38 shown in FIGS. 7*a* and 7*b*. In particular, FIG. 7*c* shows the ends of each of four prongs 40 extending from the end of the fastener 38. As noted above, the prongs 40 are elastic, allowing the prongs to compress together then expand into the mating positions described above.

Figure 9A:
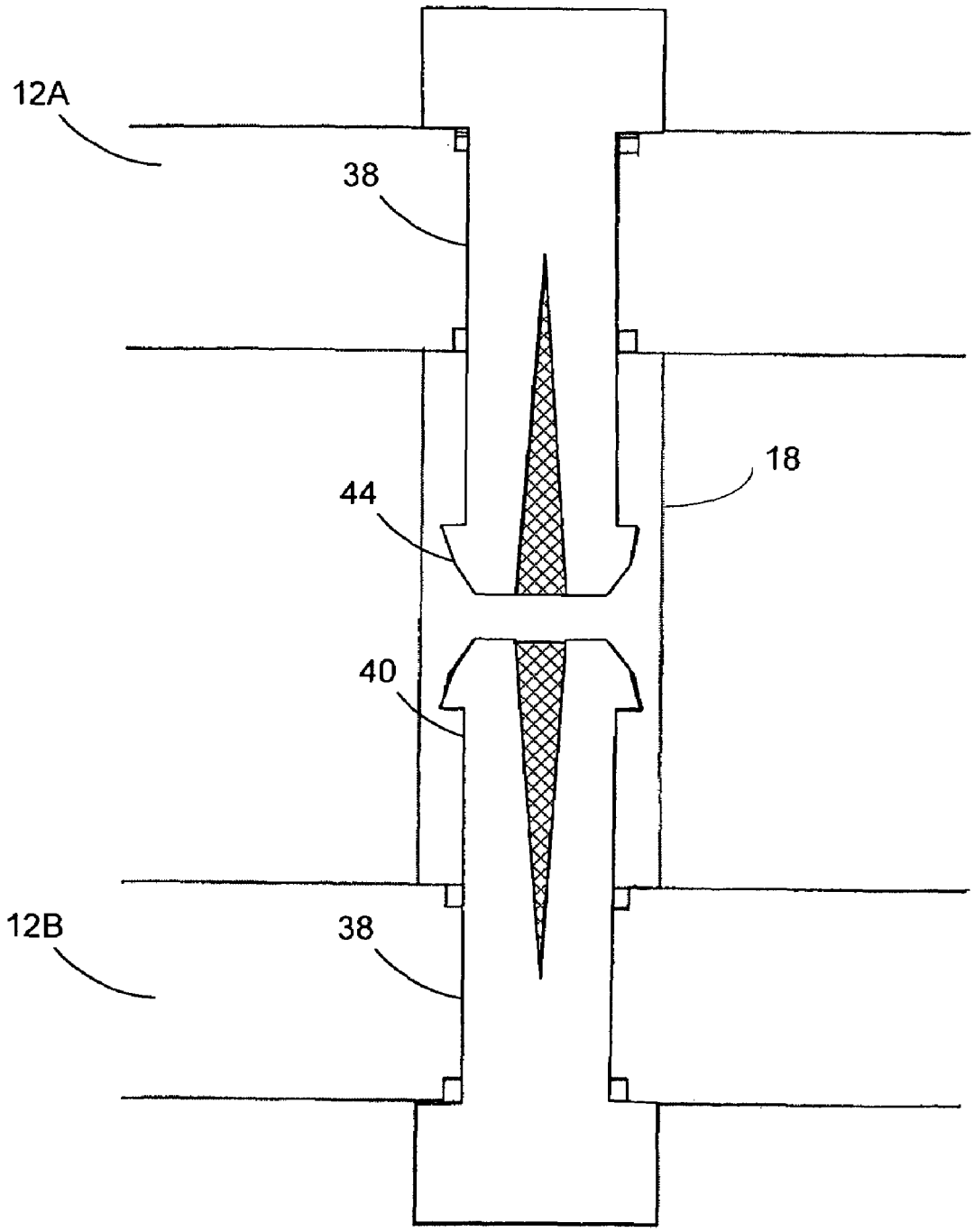
FIG. 9*a* is a cross-sectional illustration of an alternate fastener, corresponding spacer, and bounding elements which may be employed in a configurable jewelry article.
Figure 9B:
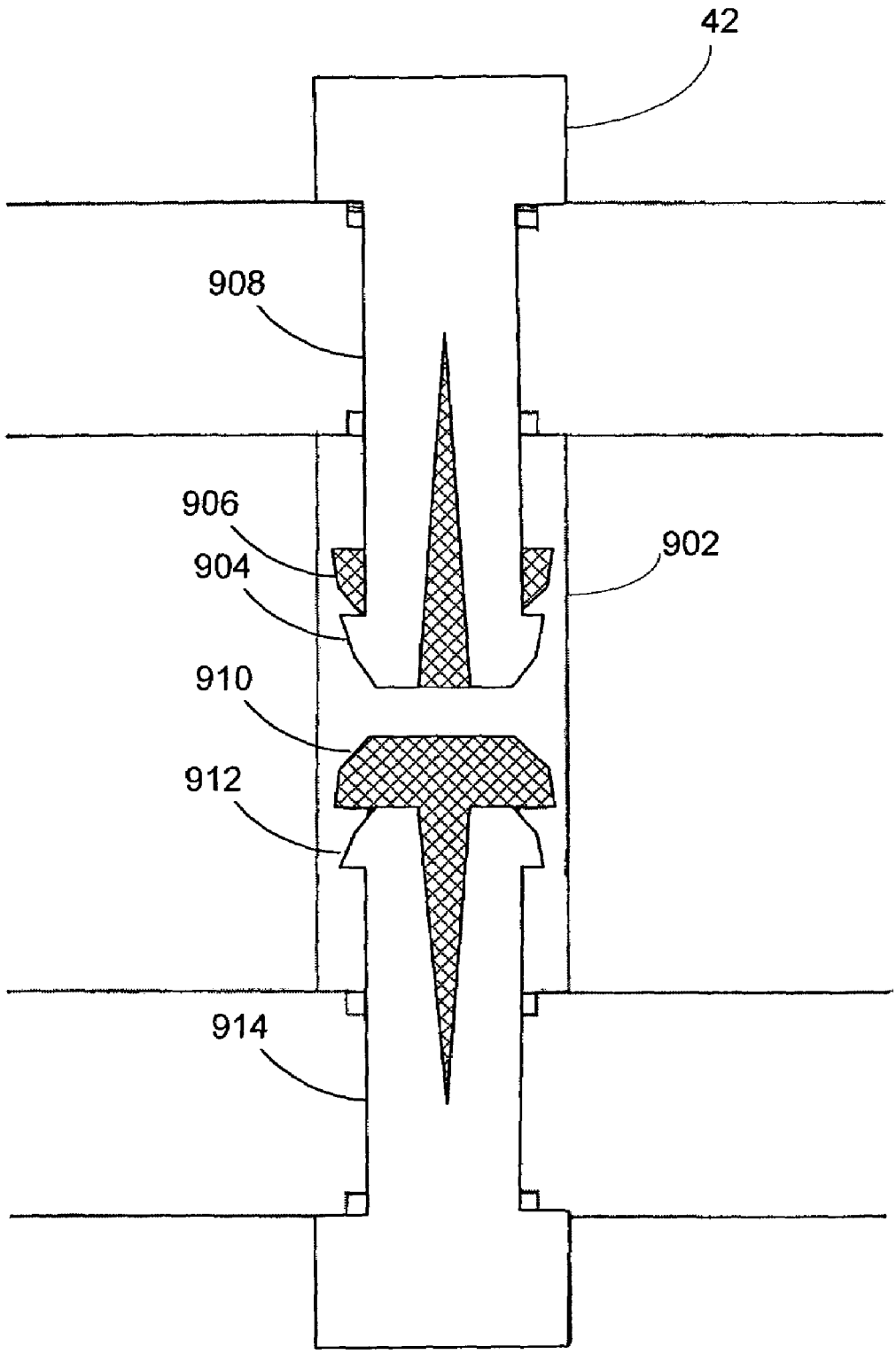
FIG. 9*b* is a cross-sectional illustration of a second example of an alternate fastener, corresponding spacer, and bounding elements which may be employed in a configurable jewelry article.

In FIG. 9*a*, two alternate pins 38 engage a common spacer 18. The pins shown in FIG. 9*a* may be formed as a single piece, including the external facing portions shown in FIG. 9*a*. The alternate pins 38 include prongs 40 at one respective end to engage internally the common spacer 18. As such, the spacer 18 need not be a hollow cylinder, but may include ring-like grooves located at one or more axial positions to interoperate with the flanges 44 and provide a selected post-assembly locking pressure or tightness FIG. 9*b* illustrates a spacer 902 which includes multiple mating positions 904, 906 for the fastener 908, and multiple mating positions 910, 912 for the fastener 914. The multiple mating positions 904, 906, 910, and 912 provide adjustable fastener tension as described above with regard to FIG. 7*b*. Additional or fewer mating positions may be provided for each fastener 908 and 914 in the spacer 902.

Figure 9C:
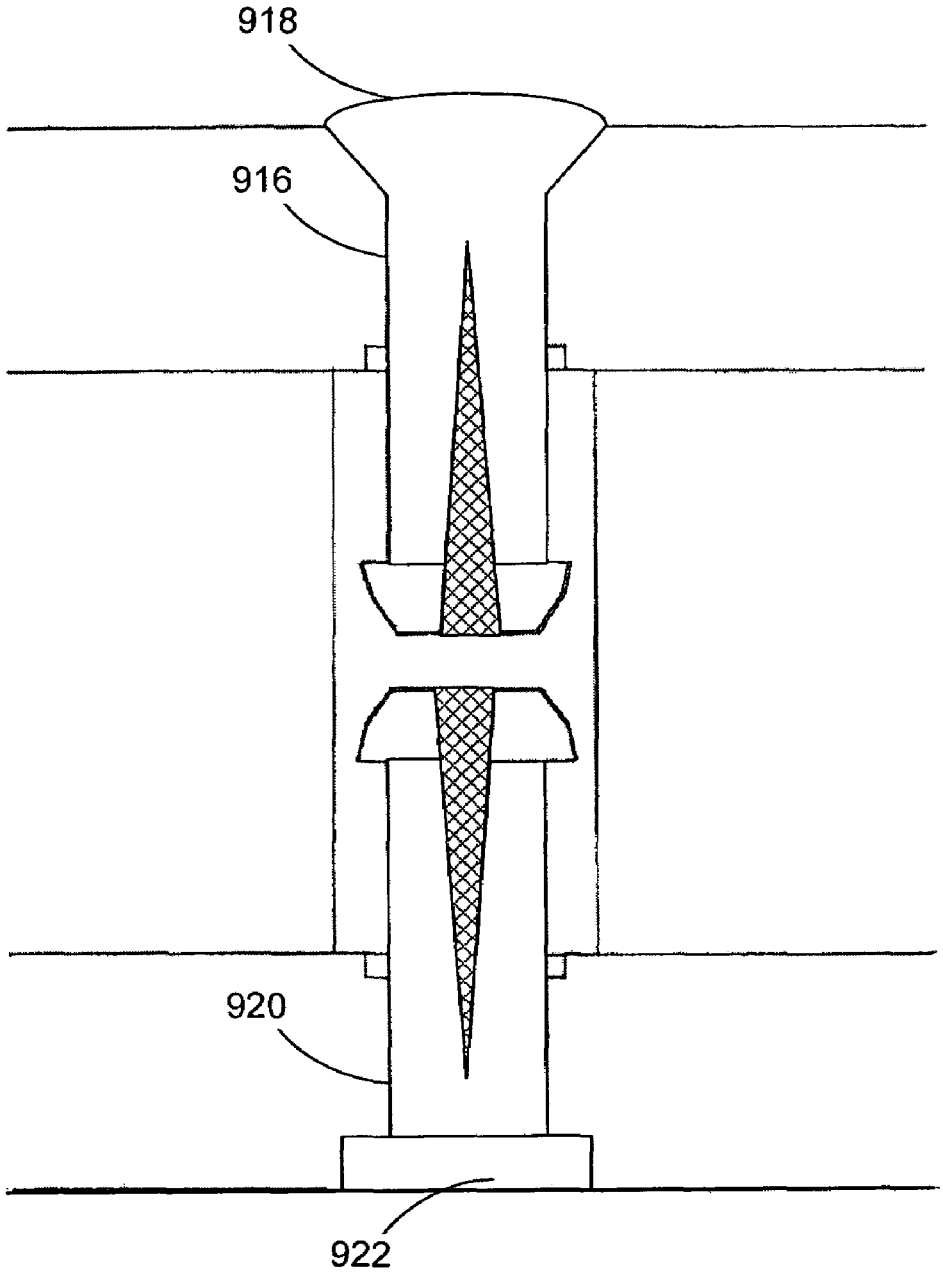
FIG. 9*c* shows alternate designs of a fastener.
Figure 10A:
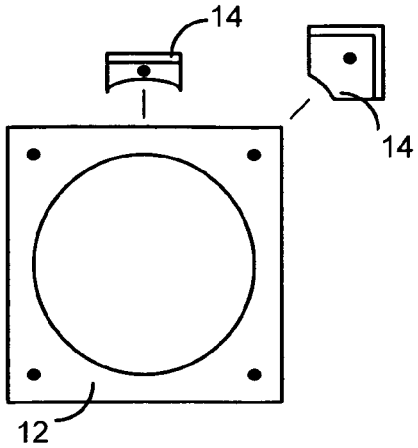
FIG. 10*a* illustrates an alternate geometry for a bounding element which may be employed in a configurable jewelry article.
Figure 10B:
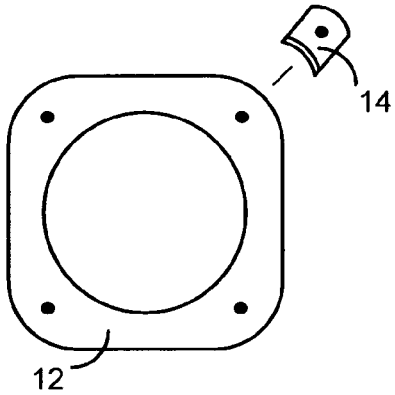
FIG. 10*b* illustrates an alternate geometry for a bounding element which may be employed in a configurable jewelry article.
Figure 10C:
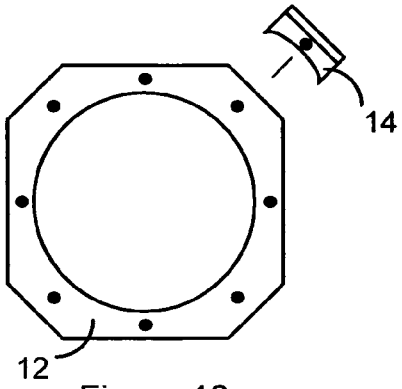
FIG. 10*c* illustrates an alternate geometry for a bounding element which may be employed in a configurable jewelry article.
Figure 10D:
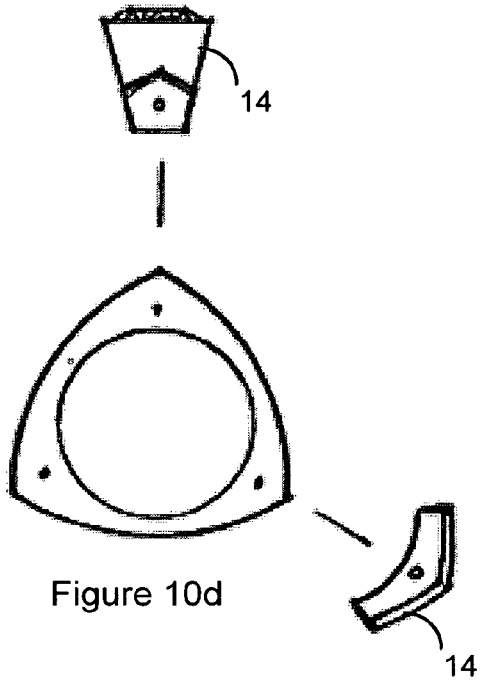
FIG. 10*d* illustrates an alternate geometry for a bounding element which may be employed in a configurable jewelry article.
Figure 10E:
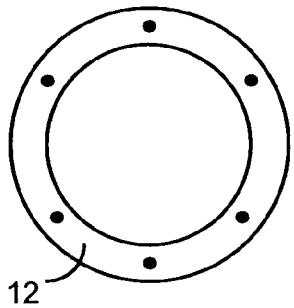
FIG. 10*e* illustrates an alternate geometry for a bounding element which may be employed in a configurable jewelry article.

FIG. 9*c* shows alternate designs of a fastener. In FIG. 9*c*, the fastener 916 provides a rounded exterior facing end 918. The fastener 920 provides a flush exterior facing end 922. Other designs may be employed for the fastener.

FIGS. 10*a*-10*e* show alternate geometries of the bounding elements 12 which may be employed in an assembly of the jewelry article 10. FIGS. 10*a*-10*e* show some of the many possibilities of geometries and sizes of the bounding elements. As examples, the bounding elements 12 may have smooth or angled corners or edges and may be rectangular, round, octagonal, triangular, or have other regular or irregular shapes.

The bounding elements 12 may have smooth, rough, decorated, or engraved outer surfaces 25, and may either have a hollow or solid core. Moreover, the spacers 18 may be adapted to receive adornments 14, and may further increase the configuration options around the periphery of the jewelry article 10. To that end, the spacers 18 may include receptacles 30 for additional adornments 14. The fasteners, spacers, caps, bounding elements, and/or other jewelry components may be selected from a set of interchangeable parts. Any or all of the parts may be precision manufactured to provide excellent fit and assembly characteristics. The interchangeability provides extensive configuration and customization options for any given piece of jewelry. For example, a customer may reconfigure their existing jewelry by selecting an interchangeable cap or spacer to replace an existing cap or fastener. Thus, any piece of jewelry may change at any time using any desired interchangeable part, without extensive time consuming and expensive labor.

Figure 11:
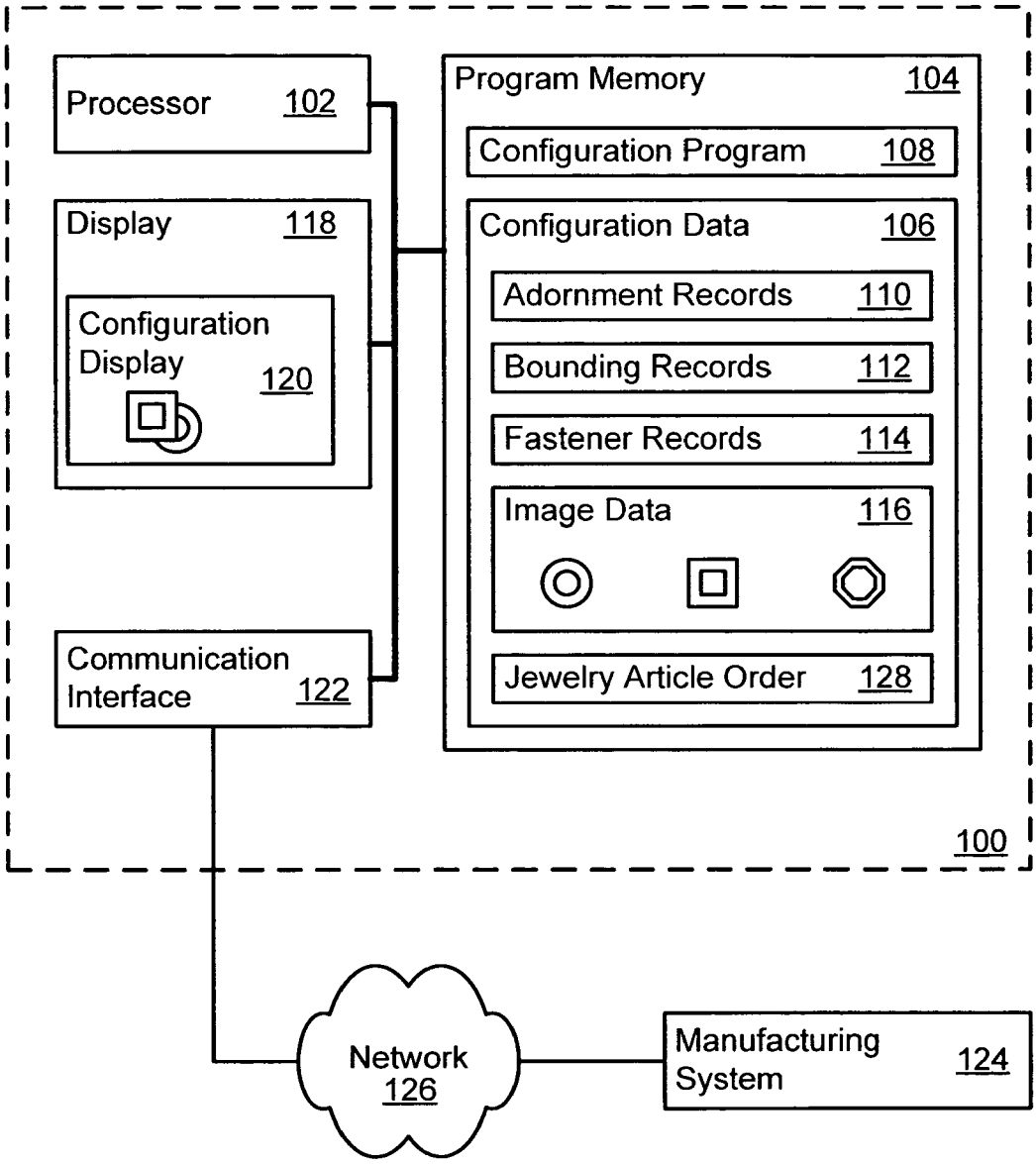
FIG. 11 is a diagram of a jewelry configuration system.

FIG. 11 shows a jewelry configuration system 100. The jewelry configuration system 100 includes a processor 102 coupled to a memory 104 and a communication interface 122. The memory 104 holds configuration data 106 and a configuration program 108 executed by the processor 102. The configuration data 106 includes adornment records 110 specifying customer selectable adornments 14, bounding element records 112 specifying customer selectable bounding elements 12, and fastener records 114 representing customer selectable fasteners 16.

The configuration data 106 may further include records specifying available configuration options for any other aspect of the jewelry article 10, such as spacer records, cap records, bezel records, or other records. The records specify the configuration options by storing the name, sizes, shapes, cost, channel options, availability, materials, and any other characteristic data for available adornments 14, bounding elements 12, fasteners 16, and any other configuration element. The records may further include image data 116 representing each configuration option (e.g., images showing each available bounding element, fastener, cap, bezel, spacer, or other available parts).

The system 100 may further include a display 118. The display 118, under control of the configuration program 108, may display selections from the records 110-114. The resulting configuration display 120 provides one or more views (e.g., 3 dimensional models) of each selected, available, or compatible configuration option, an exploded view of the resulting jewelry article, an assembled view of the jewelry article, or other graphical representations on the display 118 for the operator.

The configuration program 108 displays bounding element selections, fastener selections, adornment selections, and other configuration selections to the operator on the display 118. For example, the operator may be a store owner who interacts with a customer to design a jewelry article. Alternatively, the operator may be the customer who interacts with the configuration program 108 at a store, or at home via a network connection through a user interface provided by a web browser on their personal computer. In the later case, the customer's personal computer provides the display 118.

The configuration program 108 accepts bounding element selections, fastener selections, adornment selections, and other configuration selections from the displayed selections. The configuration program 108 may then verify manufacturing or assembly compatibility between the selections and alert the operator to any incompatibilities that may exist. For example, if a customer selects a fastener with a diameter too large to secure selected bounding elements, the configuration program 108 may alert the operator. In addition, the configuration program 108 may search the records for compatible fasteners to show the operator.

The jewelry configuration program 108 may also include instructions which initiate communication of a jewelry article order 128 to a manufacturing system 110 or other assembly location. The jewelry article order may include one or more fields specifying the selected bounding elements, fasteners, spacers, caps, bezels, finishes, materials, adornments, and any other configuration option for the jewelry article, as well as customer name and address, store name and address, and other order data. The system 100 may transmit the jewelry article order through the communication interface 122 to a manufacturing system 124, a craftsman who assembles the jewelry article, or other recipient. The communication interface 122 may be connected to a network 126 (or interconnection of networks) which communicates the jewelry article order to the manufacturing system 124.

Figure 12:
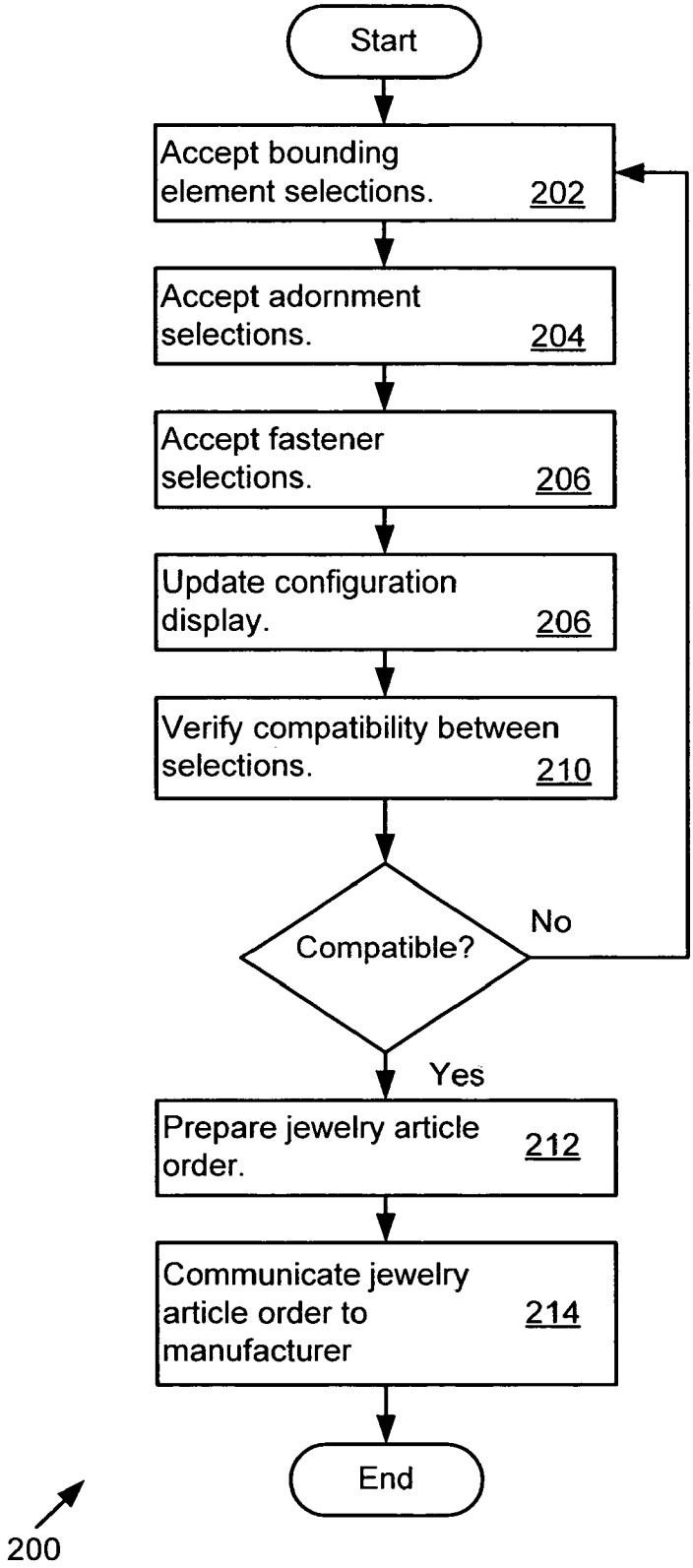
FIG. 12 is a flow diagram shown acts which the jewelry configuration system may take to specify a jewelry article.

FIG. 12 shows a flow diagram 200 of the acts which the jewelry configuration program 108 may take to configure a module article of jewelry. As shown in FIG. 12, the configuration program 108 accepts operator or customer selections of bounding elements 12 (Act 202), adornments 14 (Act 204) and fasteners 16 (Act 206), and any other configuration option. The configuration program 108 also updates the configuration display 120 to show the selections as noted above (Act 208).

The configuration program 108 verifies the selections for compatibility (Act 210). A verified jewelry article 128 order may be prepared with the configuration selections (Act 212). In addition, the configuration program 108 may communicate the jewelry article order 128 to the manufacturing system 110 (Act 214).

In other words, the user is guided by the jewelry configuration system 100 during the configuration process for a custom jewelry article. The configuration system 100 verifies the manufacturing compatibility of the configuration selections which specify the jewelry article 10. Thus, the jewelry configuration system 100 provides an efficient mechanism for creating a specific piece of modular jewelry despite the vast range of possible configurations.

It is therefore intended that the foregoing detailed description be regarded as illustrative rather than limiting, and that it be understood that it is the following claims, including all equivalents, that are intended to define the spirit and scope of this invention.

The invention claimed is:

1. A jewelry article comprising:

a first bounding element;

a second bounding element;

a spacer positioned between the first and second bounding elements;

a first channel for receiving a first portion of an adornment defined in at least one of the first bounding element and the second bounding element; and a fastener that is received in the spacer and comprising multiple elastic prongs coupling together the second bounding element and the first bounding element, wherein the fastener extends through at least one of the first bounding element and second bounding element;

whereby the fastener secures the adornment between the first bounding element and the second bounding element in the first channel.

2. The jewelry article of claim 1, further comprising a second channel defined in at least one of the first bounding element and the second bounding element for receiving a second portion of the adornment.

3. The jewelry article of claim 1, where the fastener extends through a first fastener aperture in at least one of the first and second bounding elements where the multiple elastic prongs engage a snap fit cap.

4. The jewelry article of claim 1, where the spacer is configured to engage the multiple elastic prongs.

5. The jewelry article of claim 1, where the jewelry article comprises a ring, and where the bounding elements further comprise finger apertures.

6. The jewelry article of claim 1, where the jewelry article comprises a bracelet, and where the bounding elements further comprise wrist apertures.

7. The jewelry article of claim 4, where the spacer comprises a first mating position that receives the multiple elastic prongs.

8. The jewelry article of claim 4, where the spacer comprises first and second elastic prong mating positions.

9. The jewelry article of claim 1, where the fastener comprises opposing pins each comprising multiple elastic prongs, and where the includes mating positions adapted to engage the multiple elastic prongs of the opposing pins.

10. The jewelry article of claim 1, wherein the first channel comprises a suspension material.

11. The jewelry article of claim 10, where the suspension material comprises silicone.

12. The jewelry article of claim 1, where the bounding elements comprise at least three sides.

13. The jewelry article of claim 1, where the bounding elements are circular or oval.

14. The jewelry article comprising:

a first bounding element comprising:

a first fastener aperture; and a first channel for receive a first portion of an adornment;

a second bounding element comprising:

a second fastener aperture; and a second channel for receiving a second portion of the adornment;

a fastener between the first bounding element and the second bounding element, the fastener comprising first elastic prongs operable to pass through the first fastener aperture and secure the first bounding element, and second elastic prongs operable to pass through the second fastener aperture and secure the second bounding element, whereby the fastener secures the adornment between the first bounding element and the second bounding element in the first channel and the second channel.

15. The jewelry article of claim 14, further comprising:

a cap comprising a first mating position for the first elastic prongs.

16. The jewelry article of claim 15, where the cap further comprises:

a second mating position deeper than the first mating position for the first elastic prongs.

17. The jewelry article of claim 15, where the cap further comprises:

a release aperture aligned with the first mating position.

18. A jewelry article comprising:

a first bounding element comprising:

a first fastener aperture; and a first channel for receiving a first portion of an adornment;

a second bounding element comprising a second fastener aperture;

a spacer positioned between the first fastener aperture and the second fastener aperture, the spacer comprising a first fastener mating position and a second fastener mating position;

a first fastener comprising first elastic prongs operable to pass through the first fastener aperture and engage the first fastener mating position; and a second fastener comprising second elastic prongs operable to pass through the second fastener aperture and engage the second fastener mating position.

19. The jewelry article of claim 18, where the spacer further comprises:

a third fastener mating position.

* * * * *

UNITED STATES PATENT AND TRADEMARK OFFICE

CERTIFICATE OF CORRECTION

PATENT NO. : 7,454,924 B2
APPLICATION NO. : 11/213090
DATED : November 25, 2008
INVENTOR(S) : Frank Grad It is certified that error appears in the above-identified patent and that said Letters Patent is hereby corrected as shown below:

In the Claims

In column 8, claim 9, line 58, after "and where the" insert --spacer--.

In column 9, claim 14, line 4, after "channel for" delete "receive" and substitute --receiving-- in its place.

Signed and Sealed this

Thirtieth Day of June, 2009

JOHN DOLL
*Acting Director of the United States Patent and Trademark Office*